US006360575B1

(12) United States Patent
Zavodchikov et al.

(10) Patent No.: US 6,360,575 B1
(45) Date of Patent: Mar. 26, 2002

(54) CALIBRATION OF AN INSTRUMENT FOR THE COLD-ROLLING OF TUBES

(75) Inventors: Sergey Yurievich Zavodchikov; Anatoliy Frantsevich Lositskiy; Vladimir Andreevich Kotrekhov; Vladimir Arsenievich Komissarov; Vladimir Nikolayevich Safonov; Sergey Valerjevich Krotkikh; Vasiliy Gennadjevich Devyatikh; Vladimir Alekseevich Veretennikov, all of Glazov; Oleg Viktorovich Bocharov; Viktor Fedorovich Buchovtsev, both of Moscow; Alexandr Konstantinovich Shikov, Moscow, all of (RU)

(73) Assignee: Joint Stock Company "Chepetskiy Mechanical Plant", Russian Federation ( * ) Notice: Subject to any disclaimer, the term of this patent is extended or adjusted under 35 U.S.C. 154(b) by 0 days.

(21) Appl. No.: 09/622,016

(22) PCT Filed: Jul. 5, 1999

(86) PCT No.: PCT/RU99/00219

§ 371 Date: Sep. 11, 2000

§ 102(e) Date: Sep. 11, 2000

(87) PCT Pub. No.: WO00/38852

PCT Pub. Date: Jun. 7, 2000

(30) Foreign Application Priority Data

Dec. 25, 1998 (RU) ..... 98123449

(51) Int. Cl.[7] ..... B21B 17/10

(52) U.S. Cl. ..... 72/208; 72/215; 72/252.5

(58) Field of Search ..... 72/208, 209, 214, 72/462, 467, 469, 252.5; 76/107.1, 107.4

(56) References Cited

U.S. PATENT DOCUMENTS

| | | | | |
|---|---|---|---|---|
| 3,874,212 A | * | 4/1975 | Nosal et al. | 72/209 |
| 5,321,623 A | * | 6/1994 | Ensenat et al. | 364/474.31 |
| 5,450,741 A | * | 9/1995 | Baensch et al. | 72/208 |
| 5,615,319 A | * | 3/1997 | Metzger et al. | 395/127 |

FOREIGN PATENT DOCUMENTS

| | | |
|---|---|---|
| DE | 1 777 043 | 7/1971 |
| DE | 2521882 | 10/1977 |
| FR | 2467643 | 4/1981 |
| SU | 534261 | 2/1977 |
| SU | 822937 | 4/1981 |
| SU | 825215 | 4/1981 |

OTHER PUBLICATIONS

Glen Stapleton, Cold Pilger Technology, abstract, 1996, pp. 24–26.

(List continued on next page.)

*Primary Examiner*—Ed Tolan
(74) *Attorney, Agent, or Firm*—Dellett and Walters

(57) ABSTRACT

This invention relates to the plastic metal working, particularly to tube rolling production and can be applied for tube cold pilgering on rolling machines. Tool design for tube cold pilgering, in which, in order to increase accuracy, surface quality, mechanical properties stability and decrease rolled tubes defects, the evolvement of external and profile of internal tooling are executed in the form of unified curve and represent geometrical location of various spline-functions key-points, whereupon along with geometrical parameters of spline-functions calculated curves the authors use factors defining physical-mathematical properties of rolled material and pilgering schemes.

4 Claims, 1 Drawing Sheet

OTHER PUBLICATIONS

Carl DeBoor, A Practical Guide to Splines, Applied Mathematical Sciences, vol. 27, 1985, pp. 301–303.
Mathematics Reference Bood For Engineers and Students of Technical Colleges, Moscow "Nauka" Main Editiorial Office of Phisics–Mathematics Literature, 1986, abstract, pp 504–506.
S. Reshke et al, Improving the Method of Producing Zircalloy Casing Tubes, Metal, 1986, abstract, pp 7–9, 12–14.
Z. A. Koff et al, Cold Tube Pilgering, State Science–Technical Publishing House of Ferrous and non–Ferrous Metallurgy Literature, Sverdlovsk Department, 1962, abstract, pp 180–183.

* cited by examiner

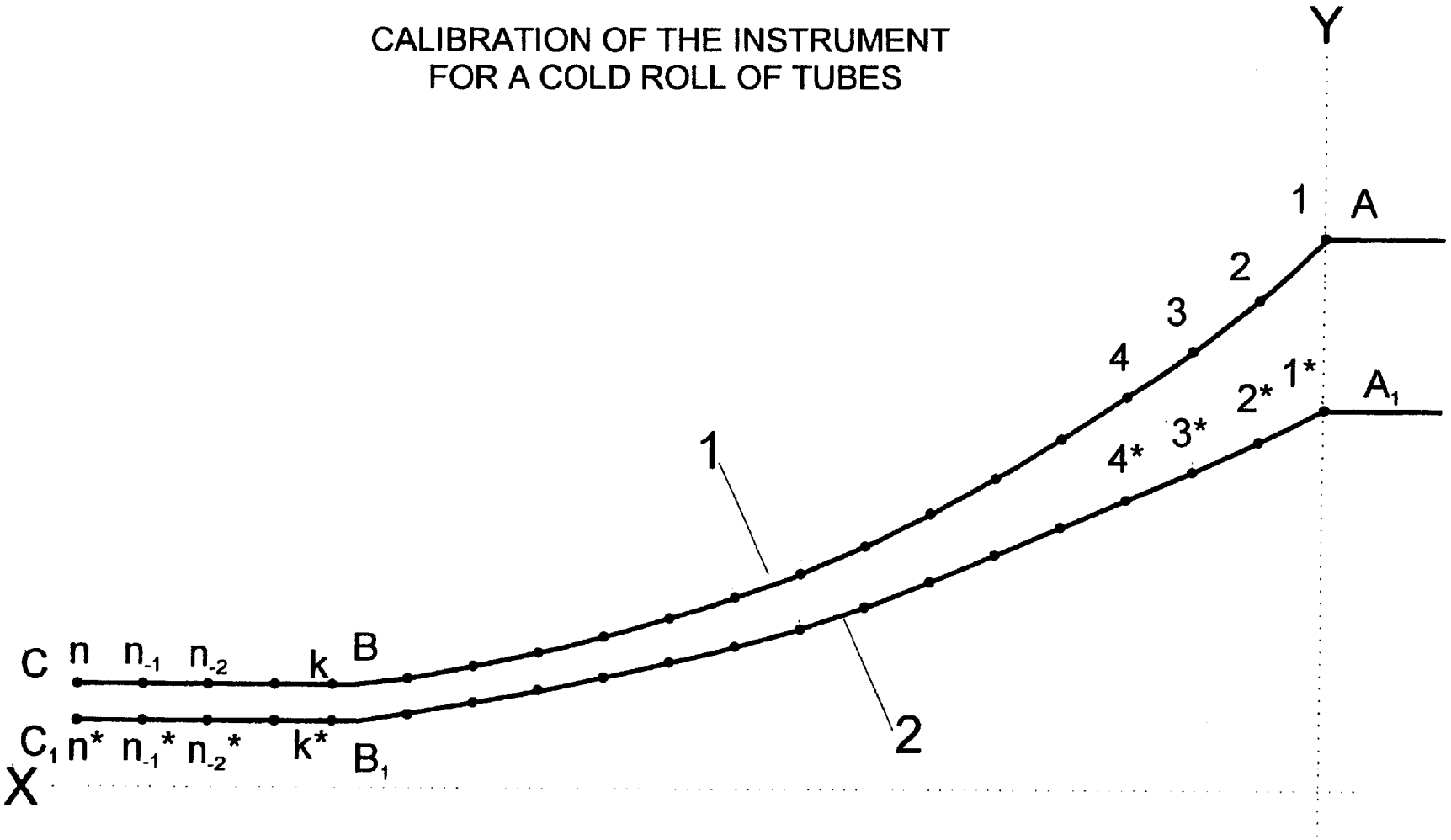
Fig.

CALIBRATION OF AN INSTRUMENT FOR THE COLD-ROLLING OF TUBES

This application is a 35 USC 371 of PCT/RU99/00219 filed Jul. 5, 1999.

THE FIELD OF THE INVENTION

This invention relates to the plastic metal working, particularly to tube rolling production and can be applied for tube cold pilgering on rolling machines.

PRIOR ART

Realization of efficient deformation scheme of rolling procedure providing stability of physical-mechanical parameters and geometrical dimensions of rolled stock is considerably defined by quality of manufacturing of working surfaces of shaping tools, smoothness of its working parts cojugation and potentialities of machine equipment to reproduce the real shape of working surface which is at most approached to the shape of calculated curve.

Available is pilger tooling consisting of mill rollers, with ridge of roll passes executed in parabola, and mandrel of decreasing cross section with parabolic generatrix, whereupon the ridge of roll pass has parabolic factor, a unit higher than the factor of mandrel generatrix parabola (Inventor's Certificate of USSR No. 534261, International Classification B 21 B 21/02, I.E. No. 41, 1976).

Available is pilger tooling including tapered mandrel and pilger rollers with roll pass having along the length of evolvement the reduction zone, the swaging zone with inclination angle of its genetrix to the mandrel axis greater than the inclination angle of mandrel genetrix, the preconditioning zone and the calibrating zone. Therewith the genetrix of the pre-conditioning zone has the inclination angle to the mandrel axes composing 0,5–0,9 of the inclination angle of mandrel genetrix, and the length of the pre-conditioning zone composes 0,3–0,6 of the length of the swaging zone (Inventor's Certificate of USSR No. 822937, International Classification B 21 B 21/02, 1.B. No. 15, 1981).

Available is pilger tooling for Zircalloy cladding tubes ( S. Reschke, A. Schaa und T. Grimmelsmann "VERBESSERUNG DES HERSTELLUNGSVERFAHRENS FUR ZIRCALOY- HULLROHRE". Metall, 1986, H. No. 4, S.338–346.), characterized by the following:

- the beginning of the ring die has the zone of weak reduction:
- the maximum deformation occurs in the first half of evolvement;
- the angle of taper at the end of the working section is minimum (0,04 mm per 10 degrees of roll barrel perimeter).

As appears from the text that when using these tools it is not totally possible to avoid the formation of small tube defects.

The most close technical decision to the claimed is design of pilger tooling in which the evolvement of calibration of the external and profile of the internal tool have the shape of constantly concave, mainly parabolic curve along the whole working length.

In this case:

- the constant, mainly parabolic curve of internal tool and the evolvement of external tool are described by one and the same mathematical function and posses identical parabolic numbers:

curve entry into calibrating section is carried on tangentially and overlaps cylindrical and tapered main shape (FRG Patent No. 1777043, 1971).

The geometry of parabolic curves of internal and external tools does not depend on physical-mechanical properties of rolled material. Constantly concave shape of evolvement of external and internal profile of tools along its total working length complicates formation of tapered tooling or internal tooling of another shape ( Z. A. Koff, P. M. Soloveytchik, V. A. Aljoshin, M. I. Grishpun "Tube Cold Pilgering". Metallurgizdat. Sverdlovsk. 1962. Glen Stapleton "COLD PILGER TECHNOLOGY". 1683 W.216$^{th}$ Street. USA. 1996).

DISCLOSURE OF THE INVENTION

The claimed invention solves the problem with improvement of geometrical dimensions accuracy and surface quality, stability of mechanical properties and decreasing of tubes' defectness.

The purpose in hand is obtained by creation of the best deformation schemes of the tube billet by means of applying working tools design calculated with regard to metal physical-mechanical properties and rolling schemes of the tube billet.

Technical result is attained by the fact that in contrast to the known design of tool made in the form of external and internal shape-forming tools, profiled along the working length in the form of parabolic curves, created on base of mathematical calculations,—geometry of curves of evolvement of profile of external tool and profile of internal tool is generated by key points of various spline-functions (I. N. Bronshtein, K. A. Semendjaev "Handbook in mathematics". Moscow. Nauka. 1986. Page 504. K. De Bor "Spline practical manual". Moscow. Radio and Communication. 1985.)

Technical result is attained also by the fact that on each stage of rolling design of each separate external or internal tool is carried out in the form of unified curve. This allows to automate the process of manufacturing of tool profiles (to use, for example, CNC).

The existing processes of manufacturing of shape-forming profiles of tools for tube cold pilgering, plotted according to calculated curves of the second and higher factors do not provide the ideal smooth transition in the points of their mutual conjugation.

Application of spline-functions for calculation made it possible to provide transition smoothness on processed surfaces in indicated points on the existing equipment.

Since spline-function with factor k with key-points sequence t appears to be any linear combination of B-splines with factor k for key-points sequence t (S k, t), choosing the quantity and sequence oft allows to combine the preferable smoothness level in break point with amount of key-points in this point. For all that the less quantity of key-points corresponds to the greater number of continuity conditions.

To provide stability of physical-mechanical properties of rolled tubes, when calculating the key points of curves as calculating parameters of spline-functions, along with geometrical parameters there are used factors considering physical-mechanical properties of rolled metal, for example, modulus of elasticity, yield strength, friction factor, and also rolling schemes: strain rate by wall thickness and tube inner diameter, volume of feed, etc.

THE BRIEF DESCRIPTION OF THE DRAWINGS

The drawing presents the evolvement of profile of pass ridge of external tool and profile of internal tool 2, where AB—the swaging section of external tool;

BC—the calibration section of external tool;

$A_1B_1$—the swaging section of internal tool;

$B_1C_1$—the calibration section of internal tool;

points 1,2,3, . . . n−1, n—are the key points of spline-function, forming the external tool profile;

points 1*,2*,3*, . . . n*−1, n*—are the key points of spline-function, forming the internal tool profile:

The evolvement of profile of pass ridge of external tool AC is executed in the form of spline-function S(x) with modulus k>3, containing n- of key-points. Profile of internal tool $A_1C_1$ is executed in the form of spline functions $S_1(x)$ with modulus $k_1>3$, containing n*—of key points.

The quantity of key-points of spline functions S(x) and $S_1(x)$ changes from 10 to 10000, depending on types of applied rolling machines and the type of external tool: segment, ring die.

In the case of rolling of low ductile metals spline functions S(x) and $S_1(x)$ have factors of curvature aimed at maximum, and in the case of rolling of ductile metals—aimed at minimum.

In order to provide the stable physical-mechanical properties of rolled material spline functions S(x) and $S_1(x)$ are calculated according to conditions of decreasing of strain rate along the length of external and internal tool.

Variants of Invention Realization

Variant 1. Production of tubes Ø9,13 mm of zirconium alloy Zr-1,0 Nb.

The billet was subjected to cold deformation during three stages for obtaining tubes of final size. The first rolling was performed on rolling machine HPT-55, the external tooling of which was executed in the form of half discs. The second rolling—on rolling machine K.PW-25, with external tooling executed in the form of ring dies, the third—on rolling machine KPW-18, the external tooling of which was executed in the form of the ring dies.

The evolvement of profile of roll pass ridge of external tooling and profile of internal tooling of rolling machine HPT-55 were formed by various spline functions: S(x) with factor k=6, containing 50 key points and $S_1(x)$ with factor $k_1=4$, containing 48 key points.

The evolvement of profile of roll pass ridge of external tooling and profile of internal tooling of rolling machine KPW-25 were formed by various spline functions: S(x) with factor k=4, containing 100 key points and $S_1(x)$ with factor $k_1=4$, containing 80 key points.

The evolvement of profile of roll pass ridge of external tooling and profile of internal tooling of rolling machine KPW-18 were formed by various spline functions: S(x) with factor k=6, containing 300 key points and $S_1(x)$ with factor $k_1=5$, containing 250 key points. Calculation of key points sequence was made according to the formula:

$D_n=Kt/[(K_t-K)/D_{n-1}+K-1]$, where $D_n$—internal tool diameter in n- section $K_t=f(G, \sigma_{0,2}, E)$—is factor depending on physical-mathematical properties of metal, G—shear modulus, $\sigma_{0,2}$—yield strength E—modulus of elasticity, $K=f(m, \mu, Q, \ldots)$—factor depending on rolling conditions, m—volume of metal feed, $\mu$—elongation per pass, Q—ratio of wall thickness deformation rate to inner tube diameter deformation rate.

After producing of tubes Ø9,13 mm there was performed checking of geometrical sizes: outer diameter deviation represented up to 30 mkm., inner diameter deviation did not exceed 25 mkm. On the outer and inner surfaces no defects were detected. Evaluation of mechanical properties along the length and section of rolled tubes showed that distribution of values does not exceed 2%. In the tubes produced according to existing technological process this distribution of values attained 10%.

Variant 2. Production of tubes Ø25,4 mm of titanium alloy VT1-0. The billet was subjected to cold deformation during two stages for obtaining tubes of final size. The first rolling was performed on rolling machine HPT-55, the external tooling of which was executed in the form of half discs. The second rolling—on rolling machine HPT-32, with external tooling also in the form of half discs.

The evolvement of profile of roll pass ridge of external tooling and profile of internal tooling of rolling machine HPT-55 were formed by various spline functions: S(x) with factor k=4, containing 80 key points and $S_1(x)$ with factor $k_1=6$, containing 80 key points.

The evolvement of profile of roll pass ridge of external tooling and profile of internal tooling of rolling machine HPT-32 were formed by various spline functions: S(x) with factor k=5, containing 120 key points and $S_1(x)$ with factor $k_1=4$, containing 200 key points.

After producing of tubes Ø25,4 mm there was performed checking of geometrical sizes: outer diameter deviation represented up to 150 mkm., inner diameter deviation did not exceed 120 mkm. On the outer and inner surfaces no defects were detected. Evaluation of mechanical properties along the length and section of rolled tubes showed that distribution of values does not exceed 5%. In the tubes produced according to existing technological process this distribution of values attained 10%.

INDUSTRIAL APPLICABILITY

From above mentioned examples it is clear that due to choosing of the best shape of calculated curve which connects smoothly calibration and swaging sections of external and internal tooling and takes into account the properties of rolled metal and rolling schemes, it became possible to improve greatly the quality of rolling process. Programs permitting to reproduct calculated profiles of external and internal technological tooling of the existing equipment were created and successfully tested at present at JSC "Chepetsky Mechanical Plant".

The software was developed by means of modulus CVMAC in system CADDS5. For working tooling manufacturing for rolling machines there were used three- and five-coordinated machines CNC—Fanuk and GG-52, which provided the maximum conformity of calculated and actual tooling geometrical parameters.

What we claim is:

1. Cold pilger tool design comprising the evolvement of design of external tooling and profile of internal tooling are executed in the form of curves plotted on base of mathematical calculations, characterized in that the curves of profile of external and profile of internal tooling present geometrical location of various spline-functions key-points.

2. The cold pilger tool design according to claim 1, characterized in that swaging and calibration sections for external or internal tooling are executed in the form of a curve.

3. The cold pilger tool design according to claim 1, characterized in that along with geometrical parameters of spline-functions of calculated curves are used factors, defining physical-mathematical properties of rolled material and rolling schemes.

4. The cold pilger tool design according to claim 2, characterized in that along with geometrical parameters of spline-functions of calculated curves are used factors, defining physical-mathematical properties of rolled material and rolling schemes.

* * * * *